United States Patent [19]

Bennett et al.

[11] Patent Number: 4,557,730

[45] Date of Patent: Dec. 10, 1985

[54] SOLUTIONS OF U.V. ABSORBERS USEFUL FOR IMPROVING THE LIGHT FASTNESS OF DYEINGS ON POLYESTER

[75] Inventors: Brian Bennett, Bradford; Donald K. Clough, Bingley, both of England

[73] Assignee: Sandoz Ltd., Basel, Switzerland

[21] Appl. No.: 611,322

[22] Filed: May 17, 1984

[30] Foreign Application Priority Data

May 23, 1983 [GB] United Kingdom ..... 8314179
Nov. 1, 1983 [GB] United Kingdom ..... 8329168

[51] Int. Cl.[4] ..... D06M 13/20; D06P 1/65; D06P 3/54; D06P 5/22

[52] U.S. Cl. ..... 8/442; 8/490; 8/492; 8/582; 8/583; 8/607; 8/922

[58] Field of Search ..... 8/492, 582, 583, 607, 8/490, 492, 442

[56] References Cited

U.S. PATENT DOCUMENTS

| | | | |
|---|---|---|---|
| 3,702,229 | 11/1972 | Campana | 8/585 |
| 3,932,128 | 1/1976 | Beaulieu | 8/583 |
| 3,950,419 | 4/1976 | Baumann et al. | 8/583 |
| 3,969,075 | 7/1976 | Forschirm | 8/607 |
| 4,032,291 | 6/1977 | Dellian | 8/583 |
| 4,229,172 | 10/1980 | Baumann et al. | 8/582 |
| 4,348,203 | 9/1982 | Skelly et al. | 8/583 |
| 4,383,835 | 5/1983 | Preuss et al. | 8/607 |

FOREIGN PATENT DOCUMENTS

| | | |
|---|---|---|
| 56-59372 | 12/1981 | Japan . |
| 810570 | 3/1959 | United Kingdom . |
| 1213398 | 11/1970 | United Kingdom . |

*Primary Examiner*—A. Lionel Clingman
*Attorney, Agent, or Firm*—Gerald D. Sharkin; Richard E. Vila; Thomas C. Doyle

[57] ABSTRACT

The invention provides a solution of one or more U.V. absorbers selected from resorcinol monobenzoate, phenyl salicylate and a benzophenone; and an emulsifier in an organic solvent system.

The solutions of the invention are useful for providing level dyeings of polyester material particularly for use in the automotive industry.

28 Claims, No Drawings

SOLUTIONS OF U.V. ABSORBERS USEFUL FOR IMPROVING THE LIGHT FASTNESS OF DYEINGS ON POLYESTER

The invention relates to compositions for dyeing polyester material, especially for use in the automotive industry.

For various shades of colour it is necessary to dye using mixtures of dyestuffs. The dyestuffs present in the mixture must be chosen on the basis of high light fastness and not, as is desirable, on the basis of having similar dyeing properties. The selection of dyestuffs of the highest light fastness leads therefore to the use of dyestuff combinations which have widely different dyeing properties; this, in turn, leads to problems of level dyeing and reproducibility. Hence, it is necessary to use a dyeing assistant such as a carrier or migration assistant in such situation. However, by using such products, the light fastness of the resultant dyeing is usually decreased.

To alleviate the problem of obtaining good light fastness properties whilst employing a carrier or migration assistant there is provided a solution of one or more U.V. absorbers selected from resorcinol monobenzoate, phenyl salicylate and compounds of formula I

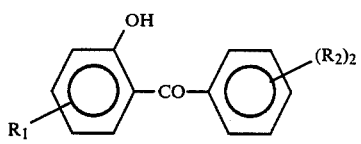

(I)

in which $R_1$ is selected from OH, halogen, $C_{1-4}$alkyl, CN, $C_{1-4}$alkoxy and hydrogen;

each $R_2$ independently, is selected from $C_{1-4}$alkoxy, CN, halogen, hydrogen, $C_{1-4}$alkyl or OH;

and an emulsifier in an organic solvent system.

It has been found that in addition to being U.V. absorbers these U.V. absorbers also act as carrier active material.

In this Specification preferably $C_{1-4}$alkyl is methyl, ethyl or propyl, more preferably methyl or ethyl; preferably $C_{1-4}$alkoxy is methoxy or ethoxy and preferably halogen is chlorine or bromine.

Preferably at least one $R_2$ is OH, methoxy or hydrogen, more preferably both $R_2$'s are hydrogen.

Preferably $R_1$ is in the 4-position and is selected from chloro, methoxy and OH.

Preferably there is provided a solution of one or more U.V. absorbers selected from resorcinol monobenzoate, 4-chloro-2,2',4'-trihydroxybenzophenone, 2,2',4-trihydroxybenzophenone, 2,4-dihydroxy-4'-methoxy benzophenone, 2,2',4,4'-tetrahydroxybenzophenone, 2,4-dihydroxybenzophenone, 2-hydroxy-4-methoxybenzophenone and phenyl salicylate; and an emulsifier in an organic solvent system.

Preferably the U.V. absorber is phenyl salicylate or a mixture of phenyl salicylate and 2-hydroxy-4-methoxy benzophenone.

Preferably a solution according to the invention is clear and on adding to water forms an emulsion.

Preferably the emulsifier is an $C_{4-12}$alkyl phenol ethoxylated with 5 to 20 moles of EtO, di-$C_{4-12}$alkyl phenol ethoxylated with 5 to 20 moles of EtO, $C_{8-18}$alcohol ethoxylated with 5 to 30 moles of EtO, $C_{12-18}$ fatty acid ethoxylated with 5 to 20 moles of EtO and castor oil ethoxylated with 5 to 50 moles of EtO. More preferably the emulsifier is an ethoxylated nonylphenol; most preferably the emulsifier is nonylphenol ethoxylated with 10 moles EtO. (EtO is ethylene oxide.)

Preferably the solvent system is a mixture of a hydrophobic solvent (preferably an ester of a fatty acid or an aromatic ester or an aromatic hydrocarbon) and a hydrophilic solvent (preferably a heterocyclic saturated compound such as pyrrolidone). A more preferred solvent system is a mixture of trimethylbenzene and N-methyl pyrrolidone (preferably in a ratio of 2:3 to 5:1 trimethylbenzene to N-methyl pyrrolidone) or a mixture of metil oil and N-methyl pyrrolidone (preferably in a ratio of 2:1 to 4:1 metil oil to N-methyl pyrrolidone). Metil oil is a mixture of methyl esters of $C_{14-18}$ fatty acids.

A further preferred solvent system may also include a chlorinated paraffin, a dibenzoate and heterocyclic saturated compounds such as pyrrolidones.

Preferably in a solution according to the invention, 20 to 50% U.V. absorber; 10 to 30% emulsifier and 10 to 60% solvent are present. All ratios given are by weight.

In the dyebath the solution according to the invention is used in amounts from 0.5 to 10% based on the weight of the material.

The solutions according to the invention may be used in all dyeing methods, including rapid dyeing.

Using solutions according to the invention dyeings are produced that are more level and are more reproducible because the U.V. absorber in the composition of the invention assists in maintaining good light fastness of dyeings whilst acting at the same time as a carrier.

The invention will now be illustrated by the following Examples in which all percentages are by weight of substrate to be dyed, all parts are by weight of 100 parts and all temperatures are in °C.

EXAMPLE 1

A product A comprising:

27 parts of 2-hydroxy-4-methoxybenzophenone
45 parts of trimethylbenzene
10 parts of N-methyl pyrrolidone and
18 parts of nonyl phenol 10 ethoxylate is prepared by stirring the components together at room temperature.

A dyebath is prepared as follows:

0.38% C.I. Disperse Yellow 42;
0.21% Foron Red SE LKJ
0.18% Foron Blue SE LKJ
0.46% C.I. Disperse Blue 87
2 g/l Sandacid PB
3.0% of product A above.

A polyester fabric is immersed in the dyebath at a goods to liquor ratio of 1:12 at 60° and the dyebath is raised to 130° at a rate of 3° per minute and the bath is maintained at this temperature for a further hour.

The dyeing prepared from this bath is dried at 100° and fixed for 30 seconds at 170°.

The dyeing prepared is grey in colour and, compared to dyeings made under identical conditions except that the dyebath does not contain 3% of the product A, the light fastness of the dyeing is significantly better when exposed for 72 hours to a Hannaue Sun Test Lamp.

EXAMPLE 2

Following the process of Example 1 but using a dyebath comprising:

2.00% C.I. Disperse Orange 37
0.14% C.I. Disperse Red 167
0.61% C.I. Disperse Blue 73
2 g/l Sandacid PB and
3.0% of the product A of Example 1, a dyeing of a brown colour is obtained and compared with a dyeing made under identical conditions except that the dyebath does not contain 3% of the product A, the light fastness of the dyeing is significantly better.

The Foron dyestuffs are commercially available from Sandoz Ltd., as is Sandacid PB, which is a buffer comprising mixed dicarboxylic acids, naphthalene sulphonic acid-formaldehyde condensate and ammonium sulphate.

EXAMPLE 3

A product B comprising:
40 parts of phenyl salicylate
30 parts of metil oil
20 parts of nonyl phenol 10 ethoxylate
10 parts of N-methyl pyrrolidone is prepared by stirring the components together at room temperature until a clear solution is obtained.

This can be substituted for product A in either Example 1 or Example 2.

EXAMPLE 4

A product C comprising:
26.6 parts of 2-hydroxy-4-methoxy benzophenone
13.4 parts of phenyl salicylate
10.0 parts of N-methyl-2-pyrrolidone
7.5 parts of diethylene glycol dibenzoate
20.0 parts of Cerechlor 50 LU (a chlorinated paraffin)
22.5 parts of nonyl phenol 10 ethoxylate is prepared by stirring the components together at room temperature until a clear solution is obtained.

This can be substituted for product A in either of Examples 1 or 2.

What is claimed is:

1. A solution comprising one or more U.V. absorbers selected from resorcinol monobenzoate, phenyl salicylate and compounds of formula I

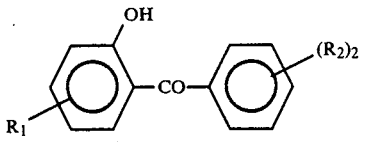

(I)

in which $R_1$ is selected from OH, halogen, $C_{1-4}$alkyl, CN, $C_{1-4}$alkoxy and hydrogen;

each $R_2$, independently, is selected from $C_{1-4}$alkoxy, CN, halogen, hydrogen, $C_{1-4}$alkyl and OH; and an emulsifier in an organic solvent system for said U.V. absorber and emulsifier comprising a mixture of a hydrophilic solvent and a hydrophobic solvent.

2. A solution according to claim 1, in which the one or more U.V. absorbers are selected from resorcinol monobenzoate, 4-chloro-2,2',4'-trihydroxybenzophenone, 2,2',4-trihydroxybenzophenone, 2,4-dihydroxy-4'-methoxybenzophenone, 2,2',4,4'-tetrahydroxybenzophenone, 2,4-dihydroxybenzophenone, 2-hydroxy-4-methoxybenzophenone and phenyl salicylate.

3. A solution according to claim 1 in which the U.V. absorber is phenyl salicylate or a mixture of phenyl salicylate and 2-hydroxy-4-methoxybenzophenone.

4. A solution according to claim 1 in which the emulsifier is a $C_{4-12}$alkyl phenol ethoxylated with 5 to 20 moles ethylene oxide; a $C_{4-12}$-dialkyl phenol ethoxylated with 5 to 20 moles ethylene oxide; a $C_{8-18}$alcohol ethoxylated with 5 to 30 moles ethylene oxide; a $C_{12-18}$ fatty acid ethoxylated with 5 to 20 moles of ethylene oxide and Castor oil ethyoxylated with 5 to 50 moles of ethylene oxide.

5. A solution according to claim 4 in which the solvent is a mixture of an ester of a fatty acid or an aromatic ester or an aromatic hydrocarbon and a pyrrolidone compound or a mixture of a chlorinated paraffin, a diethylene glycol dibenzoate and a pyrrolidone compound.

6. A process for treating a polyester fabric comprising applying to the fabric a solution according to claim 1.

7. A dyed polyester fabric to which a solution according to claim 1 and one or more disperse dyestuffs have been applied.

8. A composition according to claim 1 wherein, in formula (I), any $C_{1-4}$alkyl is methyl, ethyl or propyl, any $C_{1-4}$alkoxy is methoxy or ethoxy, and any halogen is chlorine or bromine.

9. A composition according to claim 1 wherein, in formula (I), at least one $R_2$ is OH, methoxy or hydrogen.

10. A composition according to claim 1 wherein, in formula (I), $R_1$ is in the 4-position and is chloro, methoxy or OH.

11. A composition according to claim 8 wherein, in formula (I), $R_1$ is in the 4-position and is chloro, methoxy or OH.

12. A composition according to claim 9 wherein, in formula (I), $R_1$ is in the 4-position and is chloro, methoxy or OH.

13. A composition according to claim 2 in which the emulsifier is a $C_{4-12}$alkyl phenol ethoxylated with 5 to 20 moles of ethylene oxide; a $C_{4-12}$ dialkyl phenol ethoxylated with 5 to 20 moles of ethylene oxide; a $C_{8-18}$alcohol ethoxylated with 5 to 30 moles of ethylene oxide; a $C_{12-18}$ fatty acid ethoxylated with 5 to 20 moles of ethylene oxide or Castor oil ethoxylated with 5 to 50 moles of ethylene oxide.

14. A composition according to claim 12 in which the emulsifier is a $C_{4-12}$alkyl phenol ethoxylated with 5 to 20 moles of ethylene oxide; a $C_{4-12}$ dialkyl phenol ethoxylated with 5 to 20 moles of ethylene oxide; a $C_{8-18}$ alcohol ethoxylated with 5 to 30 moles of ethylene oxide; a $C_{12-18}$ fatty acid ethoxylated with 5 to 20 moles of ethylene oxide or Castor oil ethoxylated with 5 to 50 moles of ethylene oxide.

15. A composition according to claim 13 in which the emulsifier is nonyl phenol ethoxylated with 5 to 20 moles of ethylene oxide.

16. A composition according to claim 13 in which the solvent is a mixture of an ester of a fatty acid or an aromatic ester or an aromatic hydrocarbon and a pyrolidone compound or a mixture of a chlorinated paraffin, a diethylene glycol dibenzoate and a pyrolidone compound.

17. A composition according to claim 14 in which the solvent is a mixture of an ester of a fatty acid or an aromatic ester or an aromatic hydrocarbon and a pyrrolidone compound or a mixture of a chlorinated paraffin, a diethylene glycol dibenzoate and a pyrrolidone compound.

18. A composition according to claim 15 wherein the solvent system is a mixture of trimethylbenzene and N-methyl pyrrolidone or a mixture of metil oil and N-methyl pyrrolidone.

19. A composition according to claim 1 comprising, by weight, 20 to 50% U.V. absorber, 10 to 30% emulsifier and 10 to 60% solvent.

20. A composition according to claim 16 comprising, by weight, 20 to 50% U.V. absorber, 10 to 30% emulsifier and 10 to 60% solvent.

21. A composition according to claim 18 comprising, by weight, 20 to 50% U.V. absorber, 10 to 30% emulsifier and 10 to 60% solvent.

22. A process according to claim 6 wherein the solution is applied to the fabric from a dyebath containing one or more disperse dyestuffs.

23. A process for dyeing polyester fabric which comprises treating said fabric in a dyebath containing one or more disperse dyestuffs, and 0.1 to 10%, based on the weight of the fabric, of a composition according to claim 16.

24. A process for dyeing polyester fabric which comprises treating said fabric in a dyebath containing one or more disperse dyestuffs and 0.1 to 10%, based on the weight of the fabric of a composition according to claim 21.

25. A solution according to claim 4 wherein the U.V. absorber is phenyl salicylate or a mixture of phenyl salicylate and 2-hydroxy-4-methoxybenzophenone.

26. A process for dyeing polyester fabric which comprises treating said fabric in a dyebath containing one or more disperse dyestuffs and 0.1 to 10%, base on the weight of the fabric, of a solution according to claim 4, said solution comprising, by weight, 20 to 50% U.V. absorber, 10 to 30% emulsifier and 10 to 60% solvent.

27. A process according to claim 26 wherein the solvent system is a mixture of trimethylbenzene and N-methyl pyrrolidone in a weight ratio of 2:3 to 5:1 or a mixture of metil oil and N-methyl pyrrolidone in a weight ratio of 2:1 to 4:1.

28. A process according to claim 26 wherein the U.V. absorber is phenyl salicylate or a mixture of phenyl salicylate and 2-hydroxy-4-methoxybenzophenone.

* * * * *